US006903293B2

(12) United States Patent
Sasaki

(10) Patent No.: US 6,903,293 B2
(45) Date of Patent: Jun. 7, 2005

(54) SWITCH DEVICE HAVING GOOD SENSE OF OPERATIONAL TOUCH EVEN WHEN SLIDING OPERATING KNOB OR ROCKING OPERATING KNOB IS ATTACHED THERETO

(75) Inventor: Makoto Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/964,274

(22) Filed: Oct. 12, 2004

(65) Prior Publication Data

US 2005/0082155 A1 Apr. 21, 2005

(30) Foreign Application Priority Data

Oct. 20, 2003 (JP) ..... 2003-359499

(51) Int. Cl.[7] ..... H01H 13/00; H01H 3/00

(52) U.S. Cl. ..... 200/339; 200/553; 200/5 R; 200/401

(58) Field of Search ..... 200/339, 553, 200/557, 563, 5 R, 6 R, 401, 329

(56) References Cited

U.S. PATENT DOCUMENTS 4,789,766 A * 12/1988 Krause ..... 200/302.3
5,265,716 A * 11/1993 Sawada et al. ..... 200/5 R
5,735,392 A * 4/1998 Shirasaka ..... 200/553
5,901,839 A * 5/1999 Sasaki et al. ..... 200/551
6,175,090 B1 * 1/2001 Blossfeld ..... 200/558
6,388,220 B1 * 5/2002 Sasaki et al. ..... 200/537
6,800,825 B1 * 10/2004 Sasaki et al. ..... 200/402
6,841,751 B2 * 1/2005 Sasaki et al. ..... 200/553

FOREIGN PATENT DOCUMENTS

EP 0794544 9/1997
JP 5-80770 11/1993

* cited by examiner

*Primary Examiner*—K. Lee
(74) *Attorney, Agent, or Firm*—Brinks Hofer Gilson & Lione

(57) ABSTRACT

A switch unit contains a case; a fixed contact members disposed on a bottom wall of the case; conductor plates rockably disposed on the bottom wall; driving bodies disposed on the conductor plates in a rotatable state in which the elevating movement thereof is allowed; a plate spring member for resiliently biasing the driving bodies; and a cover member for covering an upper opening of the case. The driving bodies are provided with pressed parts that protrude above the cover member. When the pressed part is driven to rotate laterally by the rocking operation of the operating knob, the driving body rotates, which causes the conductor plate to slide on the bottom wall. As a result, the switch unit is switched to its ON state.

6 Claims, 7 Drawing Sheets

SWITCH DEVICE HAVING GOOD SENSE OF OPERATIONAL TOUCH EVEN WHEN SLIDING OPERATING KNOB OR ROCKING OPERATING KNOB IS ATTACHED THERETO

This application claims the benefit of priority to Japanese Patent Application No. 2003-359499 filed on Oct. 20, 2003, herein incorporated by reference.

BACKGROUND OF THE INVENTION

1. Field of the Invention

The present invention relates to a switch device suitable for use in, for example, a driving switch of a vehicle-mounted power window apparatus, which is capable of selectively operating two sets of switch elements by rockably operating an operating knob.

2. Description of the Related Art

Conventionally, as a driving switch of a vehicle-mounted power switch, a driving switch is proposed in which two sets of slide-type switch elements are juxtaposed to each other and an operating rod of an operating knob is rockably operated to turn on the respective switch elements (for example, see Japanese Examined Patent Application Publication No. 5-80770).

FIG. 11 is an explanatory view illustrating a conventional example of such a driving switch. In this drawing, the switch unit 1 generally has a structure in which two sets of slider-type switch elements are disposed within the case (not shown) whose upper opening is covered with a cover member 2. Driving shafts 3 and 4 of the respective switch elements protrude outward from elongated holes 2*a* and 2*b* of the cover member 2. The two sets of switch elements are disposed in the case in a straight line that coincides with the sliding direction (right-and-left direction in the drawing) of the driving shafts 3 and 4. Terminals 5 of a plurality of fixed contact pieces are exposed into the case and protrude downward from the case. Although not shown, each of the switch elements is provided with a slider having the driving shaft 3 (or 4) protruding therefrom, movable contact pieces that are fixed to the slider and brought into contact with or separated from the fixed contact pieces during operation, a coil spring that normally biases the slider toward an initial position illustrated in FIG. 11, and a plate spring that is brought into resilient contact with the slider and normally biasing the movable contact pieces toward the fixed contact pieces.

The above-mentioned conventional switch unit 1 is assembled into a housing 6. An operating knob 7 is disposed in a mounting recess 6*a* of the housing 6. The operating knob 7 can swing about a spindle 8, and operating rod 9 moves (tilts) in the direction of the arrow "A" or "B" along with the swinging of the operating rod 7. Also, the tip of the operating rod 9 is inserted between the driving shafts 3 and 4 of the two sets of switch elements. Thus, when an operator pushes in the operating knob 7 to move the operating rod 9 in the direction of the arrow "A", the operating rod 9 causes the driving shaft 3 to be pushed in and slid in the left direction in the drawing against the biasing force of the coil spring. As a result, the movable contact pieces, which integrally slide with the driving shaft 3, are brought into contact with or separated from the corresponding fixed contact pieces, such that one switch element is switched from its OFF state to its ON state. In this state, when a pushing force applied to the operating knob 7 is removed, the coil spring, which has been compressed by the sliding of the driving shaft 3, biases the slider to cause the driving shaft 3 to be slid in the opposite direction. Therefore, the switch element is automatically returned to its OFF state in FIG. 11. The operation of the switch element when an operator pulls up the operating knob 7 to move the operating rod 9 in the direction of the arrow "B" is basically the same as the above-mentioned operation. Here, when the operating rod 9 pushes in the driving shaft 4 in the right direction in the drawing to allow the sliding of the driving shaft 4, the other switch element is switched from its OFF state to its ON state. When operating force applied to the operating knob 7 is removed, the switch element is automatically returned to its OFF state.

In the above-mentioned conventional example, the driving shafts 3 and 4 slides in a straight line. However, the operating rod 9 that pushes in the driving shafts 3 and 4 are members swinging about the spindle 8. Thus, the driving shafts 3 and 4 are pushed in a direction upwardly inclined with respect to the sliding direction. In addition, during operation, the driving shafts 3 and 4 are pressed against the peripheral walls of the elongated holes 2*a* and 2*b*, or the slider is pressed against the inner wall of the case 2 while being inclined. This may increase sliding resistance partially and undesirably and result in the sense of irregularity or saccade. Therefore, a problem occurs in that a good sense of operational touch is rarely obtained. Meanwhile, if the operating rod 9 is made long to arrange the spindle 8 away from the driving shafts 3 and 4, the driving shafts 3 and 4 can be pushed substantially in the sliding direction. However, in that case, the operating knob 7 may significantly protrude upward from the mounting groove 6*a* of the housing, which is not preferable.

SUMMARY OF THE INVENTION

The present invention has been made in consideration of the above problems, and an object of the present invention is to provide a switch device which makes it possible to give an operator a good sense of operational touch even if the switch device is combined with an operating knob that is rockably operated or slidably operated.

To achieve the above-mentioned object, a switch device of the present invention comprises a case having a bottom wall and an upper opening, two sets of switch elements assembled to the case, a spring member for giving a returning force to the two sets of switch elements, and a cover member for covering the upper opening of the case. The switch elements include fixed contact members exposed on an inner wall surface of the case, conductor members disposed in the case and capable of being brought into contact with or separated from the fixed contact members, and rotatable driving bodies for driving the conductor members. Pressed parts are respectively provided in the driving bodies so as to protrude above the cover member, and opposite pressing forces are respectively applied to the pressed parts of the two sets of switch elements. During operation, the driving bodies are driven to rotate via the pressed parts such that the conductor members are brought into contact with or separated from the fixed contact members, thereby allowing any of the two sets of switch elements to selectively perform opening and closing operations, and as the pressing forces are released, the driving bodies are returned to non-operating positions.

According to the switch device having the above construction, when the pressed part of any of the two sets of switch elements is driven to rotate by a rocking operation or a sliding operation of the operating knob, in the switch element concerned, the driving means is rotated to cause the conductor member to be brought into contact with the fixed contact member. Thus, the switch element can be switched. Meanwhile, in the case of the other switch element, the direction of a pressing force given to the pressed part becomes opposite. However, the switching operation of the other switch element is basically the same as that of the one switch element.

In the above-mentioned switch device, preferably, the fixed contact members of the switch elements are disposed on a bottom face of the inner wall surface, and the conductor members are rockably disposed on the bottom face of the inner wall surface and provided with inclined surfaces. The spring member is formed of a plate spring, and the spring member is attached to the case in a state pressed by the cover member. The driving bodies are allowed to be elevated and are rotatably held in the case, and sliding parts are provided to be brought into resilient contact with the conductor members by the biasing force of the plate spring member. When the driving bodies are driven to rotate via the pressed parts, the sliding parts slide on the inclined surfaces of the conductor members, the conductor members rock such that they are brought into contact with or separated from the fixed contact members, and at the same time the driving bodies moves against the biasing force of the plate spring.

According to the switch device having the above construction, when the pressed part of any of the switch elements is driven to rotate by a rocking operation or a sliding operation of the operating knob, in the switch element concerned, the driving body is rotated to cause the conductor member to slide on the corresponding inclined surface. Thus, the conductor plate can be rocked on the bottom wall of the case and can be brought into contact with and separated from the fixed contact members. In addition, the switch element can be switched from its OFF state to its ON state. Also, at the time of such switching operation, when the reaction force of the conductor plate against the driving body 17 increases or decreases, the driving body can be elevated while receiving the biasing force of the plate spring member. Therefore, it is possible to obtain a good sense of operational touch always without undesirably increasing the sliding resistance. Further, when the operating force applied to the operating knob is removed after such switching operation, the biasing force of the plate spring member causes the driving body on the inclined surface to rotate in the opposite direction and to return to its initial position on the conductor plate. Thus, the conductor plate rocks on the bottom wall in the opposite direction and returns to the OFF state automatically. Meanwhile, in the case of the other switch element, the direction of a pressing force applied to the pressed part becomes opposite. However, the operation of the other switch element is basically the same as that of the one switch element.

In the above-mentioned switch device, preferably, the driving bodies are respectively provided with driving arm parts that protrude laterally from the case. In this case, for example, a construction can be realized in which the driving arm parts are disposed above push switches juxtaposed in the vicinity of the case and the driving bodies are driven to rotate via the pressed parts, such that the driving arm parts operate to press the push switches. Therefore, even if the number of operating knobs is not increased or the shape thereof is not complicated, it is possible to easily add different operational performances by using the switch device.

The present invention relates to a switch device in which the driving body is driven to rotate such that the conductor plate is brought into contact with or separated from the fixed contact members. In case rocking operation or sliding operation of the operating knob is carried out, an angular moment that tends to flex the plate spring member is not applied to the driving body, but the driving means can be smoothly driven to rotate. As a result, a good sense of operational touch can usually be obtained.

DESCRIPTION OF THE PREFERRED EMBODIMENT

Figure 1:
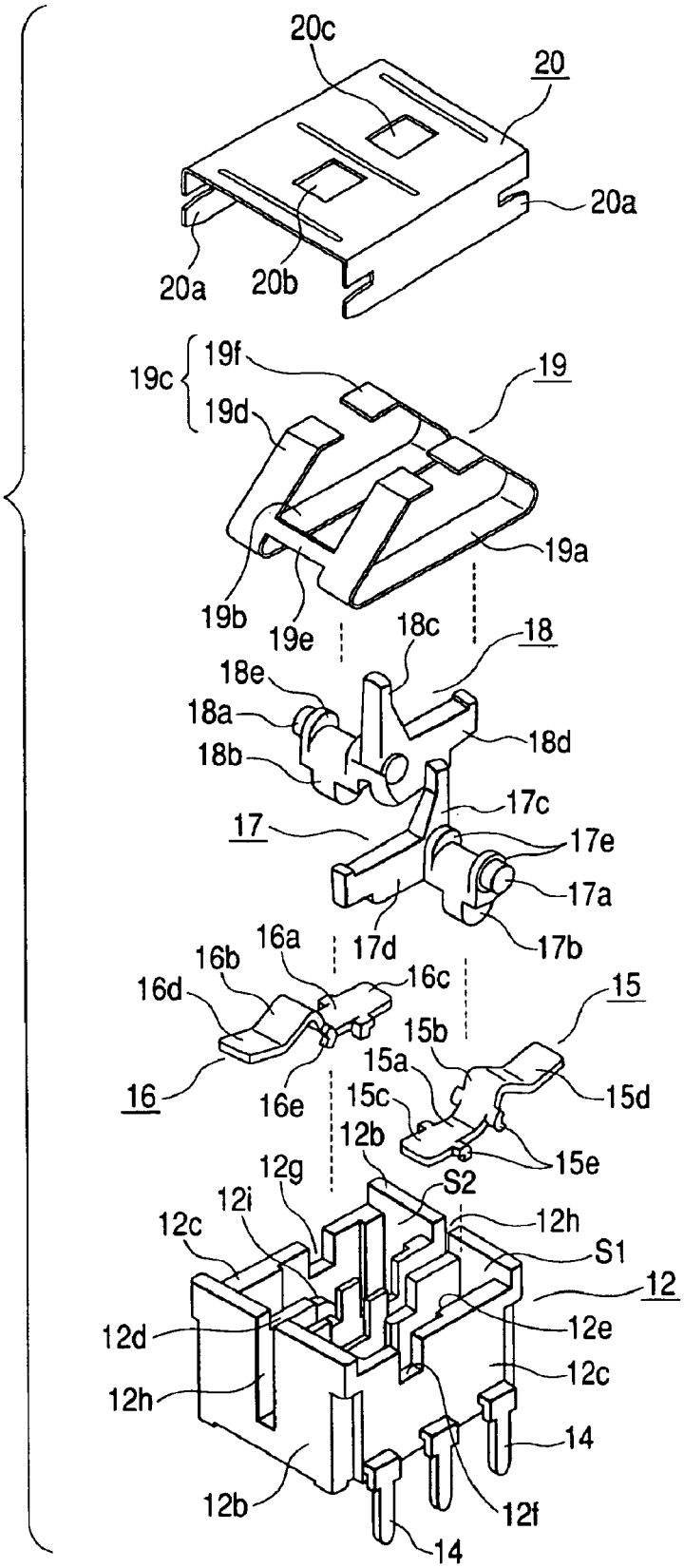
FIG. 1 is an exploded perspective view of a switch unit according to an embodiment of the present invention.
Figure 2:
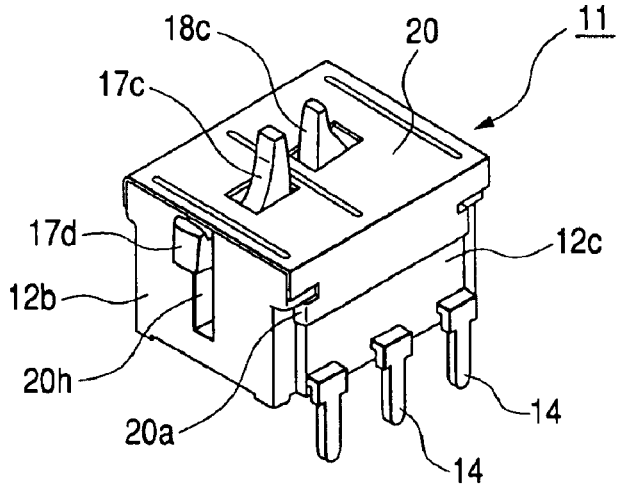
FIG. 2 is a perspective view of the switch unit.
Figure 3:
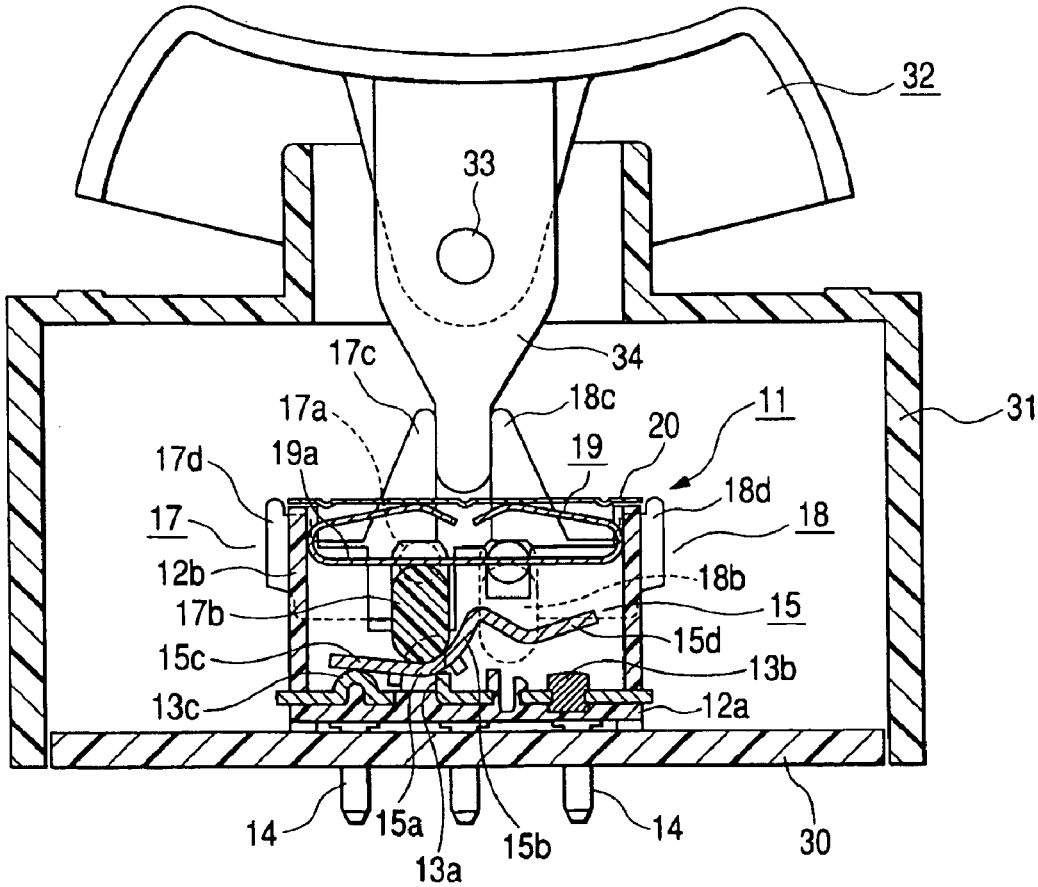
FIG. 3 is a sectional view of a driving switch in its non-operating state, in which the switch unit illustrated in FIG. 2 is combined with a rocker-type operating knob.
Figure 4:
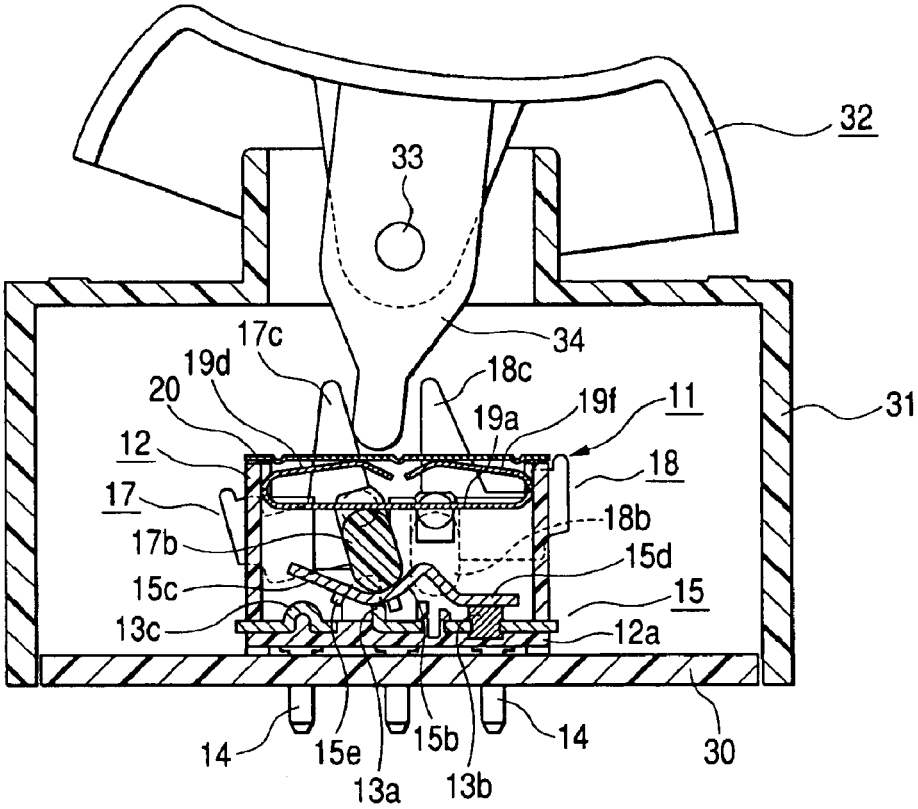
FIG. 4 is a sectional view of the driving switch illustrated in FIG. 3, in its operating state.

Preferred embodiments of the present invention will now be described with reference to the accompanying drawings. FIG. 1 is an exploded perspective view of a switch unit according to an embodiment of the present invention; FIG. 2 is a perspective view of the switch unit; FIG. 3 is a sectional view of a driving switch in its non-operating state, in which the switch unit is combined with a rocker-type operating knob; and FIG. 4 is a sectional view of the driving switch, as illustrated in FIG. 3, in its operating state.

Referring to these drawings, generally, a switch unit 11 comprises a case 12 in which sidewalls 12*b* and 12*c* and partition walls 12*d* are set up from a bottom wall 12*a* to form a pair of contact accommodation spaces S1 and S2; a fixed contact members 13*a* to 13*c* respectively disposed on the bottom wall 12*a* in the pair of contact accommodation spaces S1 and S2 by insert molding; a plurality of terminals 14 extending from the respective fixed contact members 13*a* to 13*c* and protruding downward from the case 12; a pair of conductor plates (conductor members) 15 and 16 rockably disposed on the bottom wall 12*a* in the respective contact accommodation spaces S1 and S2; driving bodies 17 and 18 disposed on the respective conductor plates 15 and 16 in a state in which the elevating movement of the driving bodies is allowed and that can rotate about shaft parts 17*a* and 18*a*; a plate spring member (spring member) 19 having a pair of pressing pieces 19*a* and 19*b* for resiliently biasing sliding parts 17*b* and 18*b* of the respective driving bodies 17 and 18 toward the bottom wall 12*a*; and a cover member 20, made of a metallic plate, that is attached to the case 12 to cover an upper opening 12*e* of the case. As illustrated in FIGS. 3 and 4, the switch unit 11 is mounted on a circuit board 30 and accommodated in a housing 31. This switch unit 11 is combined with an operating knob 32, thereby constructing a driving switch of a vehicle-mounted power window apparatus. Meanwhile, the operating knob 32 is rockably supported via spindle 33 by the housing 31. Further, the operating knob 32 is provided with an operating rod 34 that projects downward. The dimension of the operating rod 34 is set to be approximately equal to the spacing between pressed parts 17*c* and 18*c* of the driving bodies 17 and 18. The operating rod 34 is inserted between the pressed parts 17*c* and 18*c* of the driving bodies 17 and 18.

Two sidewalls 12*c* and four partition walls 12*d* are respectively set up parallel to each other from the bottom wall 12*a* at the long sides of the case 12, and two sidewalls 12*b* are respectively set up perpendicular to the sidewalls 12*c* from the bottom wall 12*a* at the short sides of the case 12. Respective uppers ends of the two sidewalls 12*c* and two partition walls 12*d* (ends at the upper opening 12*e*) are formed with notched recesses 12*f* and 12*g* into which the shaft parts 17*a* and 18*a* of the respective driving bodies 17 and 18 are inserted such that they can be elevated. The two sidewalls 12*b* at the short sides are formed at their middle portions with notched slits 12*h* whose upper ends are open. Arm parts 17*d* and 18*d* of the driving bodies 17 and 18 are inserted into the slits 12*h* such that they can be elevated. Moreover, the opposite faces of the sidewalls 12*c* and partition walls 12*d* are respectively formed with protrusions 12*i*. The upper shape of the protrusions 12*i* is circular-arc-shaped such that the conductor plates 15 and 16 are smoothly positioned during assembling.

The fixed contact members 13*a* to 13*c* are respectively aligned in rows at the inner bottom of the contact accommodation spaces S1 and S2 of the case 12. The conductor plate 15 is disposed on one group of fixed contact members, and the conductor plate 16 is disposed on the other group of fixed contact members. The fixed contact members 13*a* to 13*c* is comprised of a first fixed contact member 13*a* that is normally brought into resilient contact with the conductor plate 15 or 16 as a rocking fulcrum, and second and third contact members 13*b* and 13*c* that are brought into contact with or separated from the conductor plate 15 or 16. The plurality of terminals 14, which extend from the respective fixed contact members 13*a* to 13*c*, are connected to an external circuit.

The conductor plate 15 is a metal plate and has an initial receiving part 15*a* that supports the driving bodies 17 in a state before the operating knob 32 is attached, a rising part 15*b* having an inverted 'V' shape in side view and formed by continued inclined surfaces at one side of the initial receiving part 15*a*, a flat part 15*c* extending toward the other side of the initial receiving part 15*a*, a movable contact part 15*d* opposite to the initial receiving part 15*a* from the rising part 15*b*. The movable contact part 15*d* is capable of being brought into contact with or being separated from the fixed contact member 13*b* in the contact accommodation space S1, and the flat part 15*c* is capable of being brought into contact with or separated from the fixed contact member 13*c* in the contact accommodation space S1. Moreover, both sides of the conductor plate 15 are formed with four projections 15*e* with the initial receiving part 15*a* interposed therebetween. These projections 15*e* are caused to engage with the protrusions 12*i* of the case 12 so that the conductor plate 15 does not deviate in its longitudinal direction during the rocking thereof. The conductor plate 16 has the same shape as the conductor plate 15, and has a rising part 16*b* and flat part 16*c* on both sides of an initial receiving part 16*a*. A movable contact part 16*d* is provided to extend in the longitudinal direction of the conductor plate 16 at one side thereof and is capable of being brought into contact with or separated from the fixed contact member 13*b* in the contact accommodation space S2. The flat part 16*c* at the other end of the conductor plate 16 in its longitudinal direction is capable of being brought into contact with or separated from the fixed contact member 13*c* in the contact accommodation space 52. Both lateral faces of the conductor plate 16 are also formed with four projections 16*e* with the initial receiving parts 16*a* interposed therebetween. The projections 16*e* is engaged with the protrusions 12*i* of the case 12 so that the conductor plate 16 is not deviated in its longitudinal direction during the rocking thereof.

The driving bodies 17 has the shaft part 17*a* as the center of rotation, the sliding part 17*b* that are normally into resilient contact with the conductor plate 15 by a biasing force of the pressing piece 19*a* of the late spring member 19, the pressed part 17*c* that extends upward and protrudes above the cover member 20, and the arm part 17*d* that extends laterally and is inserted into one of slits 12*h*. A pair of opposite guide walls 17*e* is formed at predetermined spacing therebetween on the sliding part 17*b*. Similarly, the driving body 18 has the shaft part 18*a* serving as the center of rotation, the sliding part 18*b* that are normally brought into resilient contact with the conductor plate 16 by a biasing force of the pressing piece 19*b* of the plate spring member 19, the pressed part 18*c* that extends upward and protrudes above the cover member 20, and the arm part 18*d* that extends transversely and is inserted into the other one of slits 12*h*. A pair of opposite guide walls 18*e* is formed at predetermined spacing therebetween on the sliding part 18*b*. The driving bodies 17 and 18 are assembled into the case 12 in such a manner to establish point symmetry in plan view. The arm parts 17*d* and 18*d* and the pressed parts 17*c* and 18*c* are disposed in a straight line. In other words, when the driving bodies 17 and 18 are assembled into the case 12, the arm parts 17*d* and 18*d* are disposed in a narrow space between the contact accommodation spaces S1 and S2 in the case 12, such that the shaft part 17*a* of the driving body 17 is inserted into the mutually opposed recesses 12*f*, and the shaft part 18*a* of the driving body 18 is inserted into the mutually opposed recesses 12*g*.

The plate spring member 19 is obtained by press-forming one resilient metal plate in the shape as illustrated in FIG. 1. The plate spring 19 member is formed such that the lower ends of compressed parts 19*c* having a truncated chevron-shape in side view are connected to each other by the pair of pressing pieces 19*a* and 19*b* extending parallel to each other. It is noted herein that the compressed parts 19*c* are parts that are compressed by the cover member 20*c* to generate spring pressure in the respective pressing pieces 19*a* and 19*b*. The compressed part 19 is comprised of a substantially H-shaped first bent piece 19*d* obtained by bending back portions extending from longitudinal ends of the pressing pieces 19*a* and 19*b* on one side thereof at an acute angle and by bridging the extending portions with a bridging part 19*e*, and a substantially H-shaped second bent piece 19*f* obtained by bending back portions extending from the other longitudinal ends of the pressing pieces 19*a* and 19*b* at an acute angle and by bridging the extending portions with a bridging part (not shown). The plate spring member 19 is assembled into the uppermost portion in the case 12 during assembling, such that one pressing piece 19*a* is disposed on the sliding part 17*b* of the driving body 17 and the other pressing piece 19*b* is disposed on the sliding pressing part 18*b* of the driving body 18. In this case, the pressing pieces 19*a* and 19*b* are respectively inserted between the guide walls 17*e* and between the guide walls 18*e* so that they can be positioned in the widthwise direction thereof. Further, the longitudinal dimension of the plate spring member 19 is set to be approximately equal to the spacing between the pair of opposite sidewalls 12*b* of the case 12 so that the respective pressing pieces 19*a* and 19*b* can be positioned in the longitudinal direction thereof.

The cover member 20 is formed at four corners thereof with attachment pieces 20*a*. The attachment pieces 20*a* are bent and locked in the four corners of the case 12, whereby the cover member 20 is attached to the case 12 while covering the upper opening 12*e*. When the cover member 20 is attached to the case 12 in this way, this presses and flexes the bent pieces 19*d* and 19*f* of the cover member 19, which was previously assembled into the case 12. Therefore, spring pressure is generated in the respective pressing pieces 19*a* and 19*b*. As a result, one pressing piece 19*a* resiliently biases the sliding operating part 17*b* of the pressing means 17 toward the bottom wall 12*a*. This biasing force causes the sliding part 17*d* to be brought into resilient contact with the conductor plate 15. Thus, when the driving body 17 is rotated about the shaft part 17*a*, the sliding part 17*b* can slide on the rising part (inclined surface) 15*b* of the conductor plate 15 to rotatably drive the conductor plate 15. Similarly, the other pressing piece 19*b* resiliently biases the sliding part 18*b* of the driving body 18 toward the bottom wall 12*a*. This biasing force causes the sliding part 18*b* to be brought into resilient contact with the conductor plate 16. Thus, when the driving body 18 is rotated about the shaft part 18*a*, the sliding part 18*b* can slide on the rising part (inclined surface) 16*b* of the conductor plate 16 to rotatably drive the conductor plate 16. Further, the cover member 20 is formed with a window hole 20*b* for causing the pressed part 17*c* of the driving body 17 to be inserted therethrough and a window hole 20*c* for causing the pressed part 18*c* of the driving body 18 to be inserted therethrough.

The above-described switch unit 11 is constructed such that a first switch element and a second switch element are juxtaposed in the case 12. The first switch element has the fixed contact members 13*a* to 13*c*, the conductor plate 15, the driving body 17, the pressing piece 19*a*, etc., disposed in the contact accommodation space S1. The second switch element has the fixed contact members 13*a* to 13*c*, the conductor plate 16, the driving body 18, the pressing piece 19*b*, etc., disposed in the contact accommodation space S2. It is noted herein that a spring member for giving a restoring force to the first and second switch elements is the only common plate spring member 19.

Further, when the switch unit 11 is combined with the operating knob 32, the tip (lower end) of the operating rod 34 is inserted between the pressed parts 17*c* and 18*c* of the driving bodies 17 and 18. At this time, the operating rod 34 is brought into resilient contact with the pressed parts 17*c* and 18*c* in a state where pretension is applied (pressure-applied state) to the pressed parts so that the looseness between the operating knob 32 and the driving bodies 17 and 18 can be avoided. In other words, in such a pressure-applied state, the sliding parts 17*b* and 18*b* of the driving bodies 17 and 18 abut on the inclined surfaces of the rising parts 15*b* and 16*b* of the conductor plates 15 and 16, respectively, close to the lower ends thereof. However, in a state of the operating knob 32 being detached, the sliding parts 17*b* and 18*b* abut on the initial receiving parts 15*a* and 16*a*, respectively, of the conductor plate 15 and 16. For this reason, the pressed parts 17*c* and 18*c* is slightly inclined toward a position more approaching each other than the position illustrated in FIG. 3.

The operation of the driving switch in which the switch unit 11 is combined with the operating knob 32, as described above, will be described below. In a standby state (the above-mentioned pressure-applied state) in which an operating force is not applied, the sliding part 17*b* of the driving body 17 is brought into resilient contact with the lower end of the rising part 15*b* of the conductor plate 15. Thus, the fixed contact members 13*a* and 13*c* in the contact accommodation space S1 are electrically conducted to each other via the conductor plate 15, and the fixed contact members 13*a* and 13*b* are kept in a mutually non-conducted state therebetween. Further, the sliding part 18*b* of the driving body 18 is brought into resilient contact with the lower end of the rising part 16*b* of the conductor plate 16. Thus, the fixed contact members 13*a* and 13*c* in the contact accommodation space S2 are electrically conducted to each other via the conductor plate 15, and the fixed contact members 13*a* and 13*b* are kept in a mutually non-conducted state therebetween.

In this state, for example, when an operating force for pushing in the right end of the operating knob 32, as illustrated in FIG. 3, is applied, the tip of the tilted operating rod 34 is driven to rotate in a certain plane, whereby the pressed part 17*c* is driven to rotate to the left in the drawing in the plane. Therefore, the driving body 17 rotates in the counterclockwise direction in the drawing about the shaft part 17*a* that extends in a direction orthogonal to the plane on which the pressed part 17*c* moves. With the rotation of the driving body 17, the sliding part 17*b* slides on the rising part 15*b* of the conductor plate 15 in the upwardly inclined direction. In this process, the driving body 17 is pushed up against the pressing piece 19*a*. Then, at the point of time when the sliding part 17*b* has passed over the fixed contact member 13*a* in the contact accommodation space S1, the conductor plate 15 is driven to rotate in the clockwise direction in the drawing and put in a state illustrated FIG. 4. As a result, since the flat part 15*c* is separated from the fixed contact member 13*c* and the movable contact part 15*d* abuts on the fixed contact member 13*b*, a switching-on signal (a driving signal that allows a window to open) resulting from the configuration that the fixed contact members 13*a* and 13*b* are electrically conducted to each other via the conductor plate 15 is output to the terminal 14.

Further, in the state of FIG. 4, when the operating force applied to the operating knob 32 is removed, the restoring force of the pressing piece 19*a* is exerted on the driving piece 17 to cause the sliding part 17*b* to move along the inclined surface of the rising part 15*b* in the downwardly inclined direction. This movement causes the driving body 17 to rotate in the clockwise directing in the drawing. Therefore, at the time when the sliding part 17*b* has passed over the fixed contact member 13*a*, the conductor plate 15 is driven to rotate in the counterclockwise direction in the drawing, and the tilted operating rod 34 is pushed back by the pressed part 17*c*. As a result, since the movable contact part 15*d* of the conductor plate 15 is separated from the fixed contact member 13*b* and the flat part 15*c* abuts on the fixed contact member 13*c*, a switching-off signal resulting from the configuration that the electrical conduction between the fixed contact members 13*a* and 13*b* are interrupted, is output from the terminal 14, and the operating knob 32 is returned to its standby state (OFF state) illustrated in FIG. 3

Meanwhile, in such a standby state, the operation of the driving switch when an operating force for pushing in the left end of the operating knob 32 illustrated in FIG. 3, is applied is also basically the same as the above-described operation. In this case, the tip of the tilted operating rod 34 drives the pressed part 18*c* to be pressed to the right in the drawing. Therefore, the driving body 18 rotates in the clockwise direction in the drawing, and the sliding part 18*b* slides on the rising part 16*b* of the conductor plate 16 in the upwardly inclined direction. In this process, the driving body 18 can be slightly pushed up against the pressing piece 19*b*. Also, at the time when the sliding part 18*b* has passed over the fixed contact member 13*a* in the contact accommodation space S2, the conductor plate 16 is driven to rotate, a switching-on signal (a driving signal by which a window is closed) resulting from the configuration that the fixed contact members 13*a* and 13*b* are electively conducted to each other, is output from the terminal 14. Thereafter, when the operating force applied to the operating knob 32 is removed, the restoring force of the pressing piece 19*b* causes the sliding part 18*b* to move in the downwardly inclined direction along the inclined surface of the rising part 16*b*. As the sliding operating part 18*b* moves, the driving body 17 rotates in the opposite direction. Therefore, the conductor plate 16 is driven to rotate in the opposite direction, and the operating rod 34 is pushed back by the pressed part 18*c*, and returned to the standby state (OFF state) illustrated in FIG. 3.

As described above, in the switch unit 11 according to the present embodiment, when the rocking operation of the operating knob 32 drives the pressed part 17*c* (or 18*c*) of the switch element to be pressed sideways, the driving body 17 (or 18) rotates. At this time, since the driving body 17 (or 18) is given only the angular moment around the shaft part 17*a* (or 18*a*) without abutting on the inclined surface of the rising part in its inclined state. Thus, a good sense of operational touch can usually be obtained. Further, along with the rotation of the driving body 17 (or 18), the conductor plate 15 (or 16) is adapted to rock on the bottom plate 12*a*, thereby allowing the switch element to be switched from its ON state to its OFF state. Thus, the switch element can be applied to a bipolar or double-throw driving switch, thereby securing high reliability. Moreover, at the time of the switching operation of the switch unit 11, the reaction force of the conductor plate 15 (or 16) against the driving body 17 (or 18) increases or decreases. However, the driving body 17 (or 18) can be elevated while receiving the biasing force of the plate spring member 19, and when the reaction force from the conductor plate 15 (or 16) increases, the pressing piece 19*a* (or 19*b*) can be pushed and flexed. Therefore, it is possible to obtain a good sense of operational touch always without undesirably increasing the sliding resistance.

Meanwhile, since the conductor plates 15 and 16, the driving bodies 17 and 18, the plate spring member 19 and the cover member 20 are assembled in this order onto the bottom wall 12*a* of the case 12 in assembling the switch unit 11, a good assembling property can be expected. Further, at the time of the assembling, the conductor plate 15 and 16 can be positioned by the protrusions 12*i* of the case 12, the driving bodies 17 and 18 can be positioned by the recesses 12*f* and 12*g* and slits 12*h* of the case 12, and the plate spring member 19 can be positioned by the sidewalls 12*b* of the case 12 and the guide walls 17*e* and 18*e* of the driving bodies 17 and 18. Thus, even if the automatic assembling is performed, the positional deviation and falling of those parts hardly occur. As a result, the assembling cost can be remarkably reduced.

Figure 5:
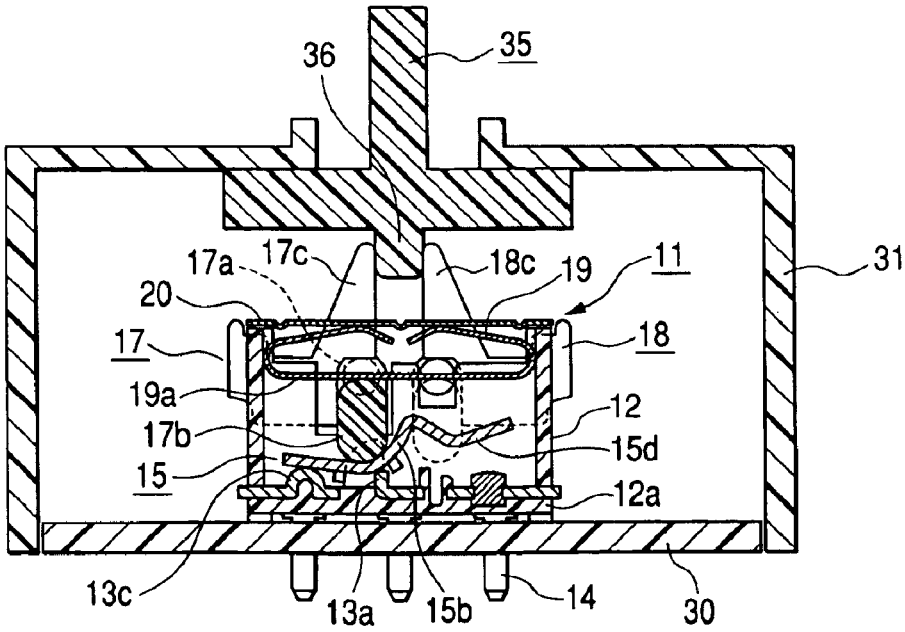
FIG. 5 is a sectional view of a driving switch in its non-operating state, in which the switch unit illustrated in FIG. 2 is combined with a slide-type operating knob.
Figure 6:
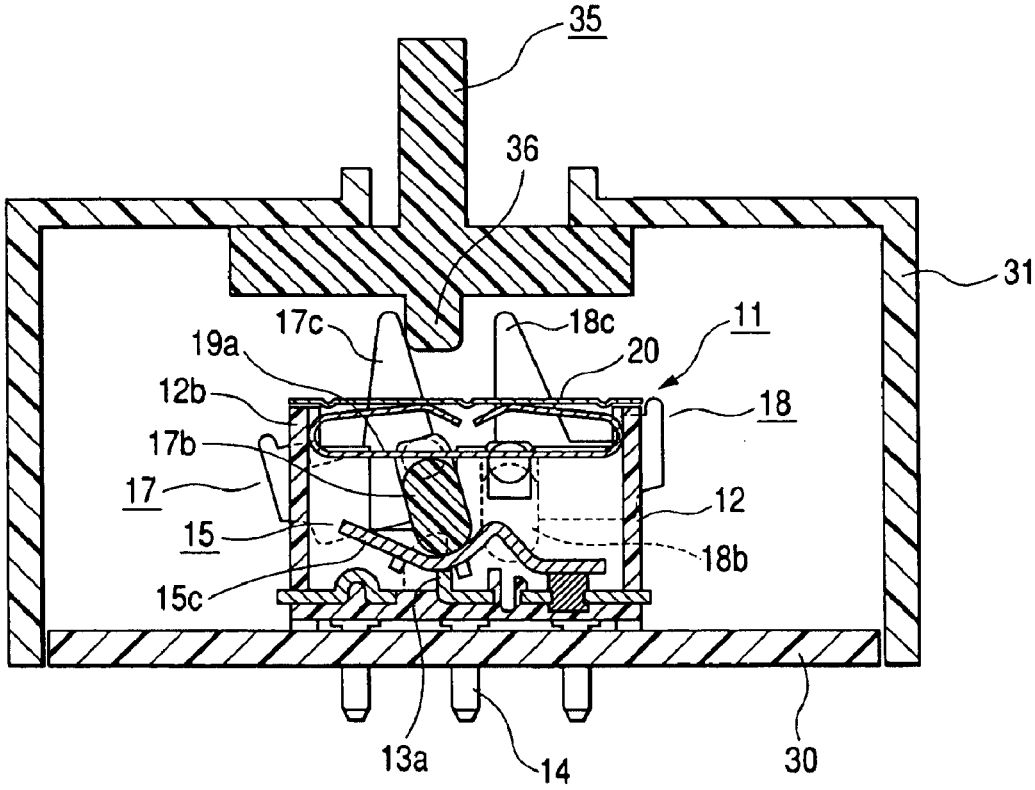
FIG. 6 is a sectional view of the driving switch illustrated in FIG. 5, in its operating state.

Next, another application of the above-described switch unit 11 will be described. FIG. 5 is a sectional view of the driving switch in its non-operating state, in which the switch unit 11 is combined with a slide-type operating knob, and FIG. 6 is a sectional view of the driving switch illustrated in FIG. 5, in its operating state. In these drawings, an operating knob 35 is supported in a guide groove (not shown) provided in the housing 31 so that it can slide in the right-and-left direction. A driving projection 36 is provided to protrude from the bottom side of the operating knob 35. The driving projection 36 is inserted between the pressed parts 17*c* and 18*c* of the driving bodies 17 and 18 of the switch unit 11.

Accordingly, when the operating knob 35 is slidably operated in the left direction in the drawing in the standby state (OFF state) illustrated in FIG. 5, the driving projections 36 pushes in the pressed part 17*c* in the same direction. Therefore, the driving body 17 rotates in the counterclockwise direction in the drawing, which in turn causes the conductor plate 15 to be driven to rotate in the clockwise direction in the drawing and to be switched to the ON state illustrated in FIG. 6. Then, when the operating force applied to the operating knob 35 is removed, the restoring force of the pressing piece 19*a* causes the driving body 17 to rotate in the opposite direction. As a result, the conductor plate 15 is driven to rotate in the opposite direction and returned to the standby state illustrated FIG. 5. As such, not only the switch unit 11 can be applied to the rocker-type operating knob 32, but also it can be combined with the slide-type operating knob 35 and smoothly operated. As a result, a good sense of operational touch can be obtained. Meanwhile, since the series of operations has already been described in detail referring to FIGS. 3 and 4, the duplicated description thereof will be omitted. Further, since the operation of the driving switch, when the operating knob 35 is operated to slide in the right direction in the drawing and thereby the driving projection 36 pushes in the pressed part 18*c* in the same direction, can be easily inferred from the description up to now, the detailed description thereof will be omitted.

Figure 7:
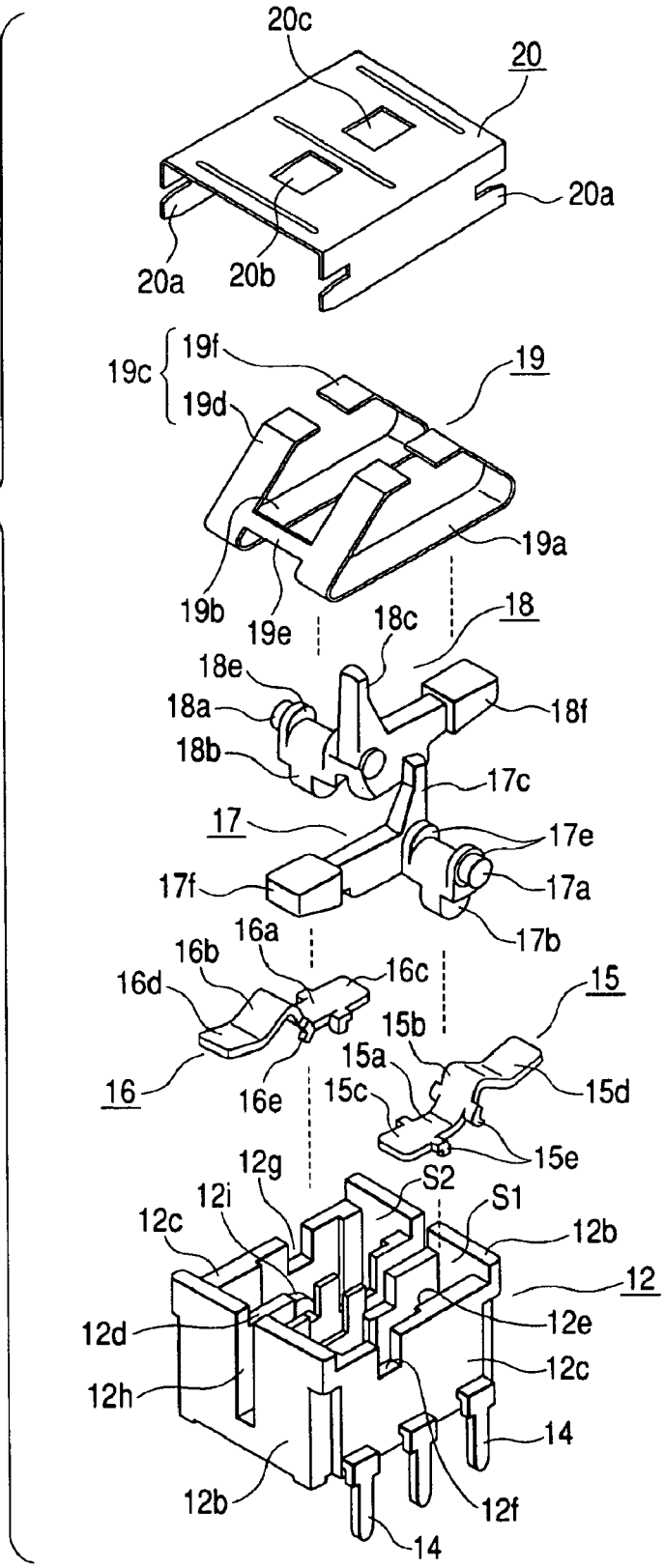
FIG. 7 is an exploded perspective view of a switch unit according to another embodiment of the present invention.
Figure 8:
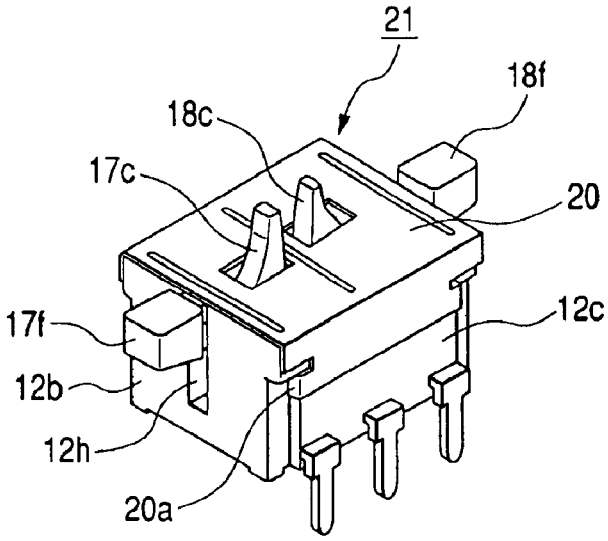
FIG. 8 is a perspective view of the switch unit.
Figure 9:
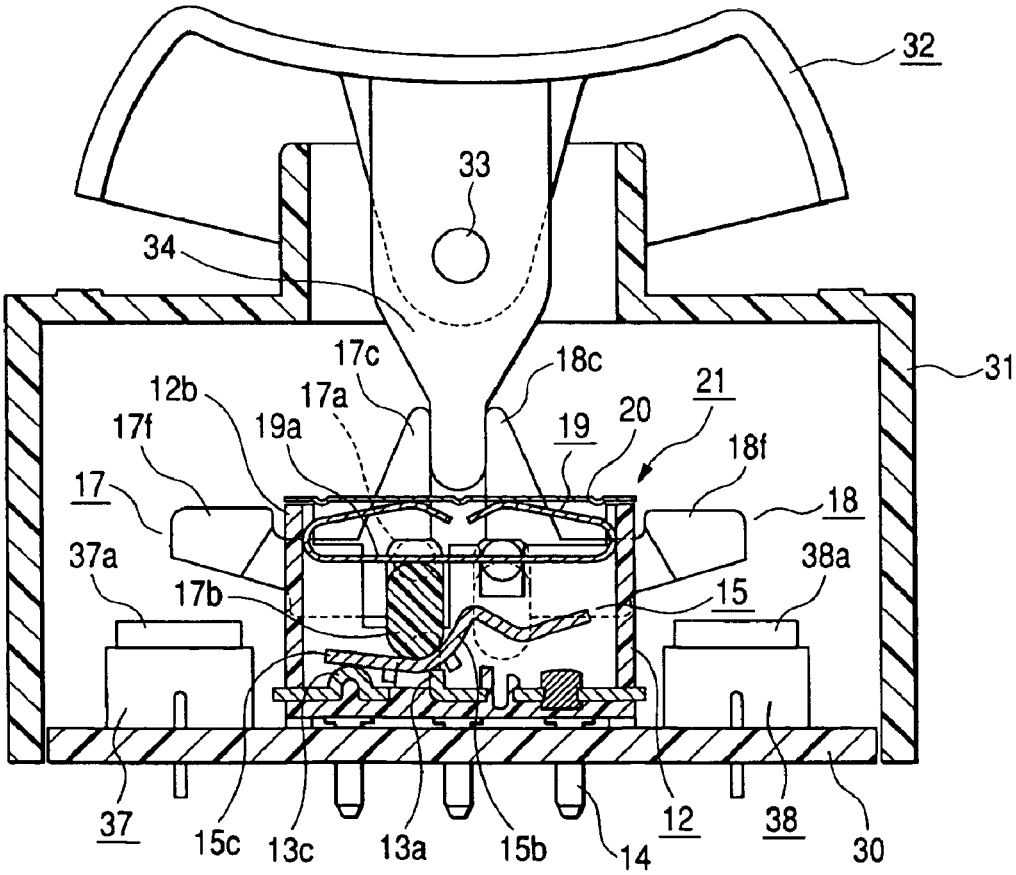
FIG. 9 is a sectional view of a driving switch in its non-operating state, in which the switch unit illustrated in FIG. 8 is combined with a rocker-type operating knob.
Figure 10:
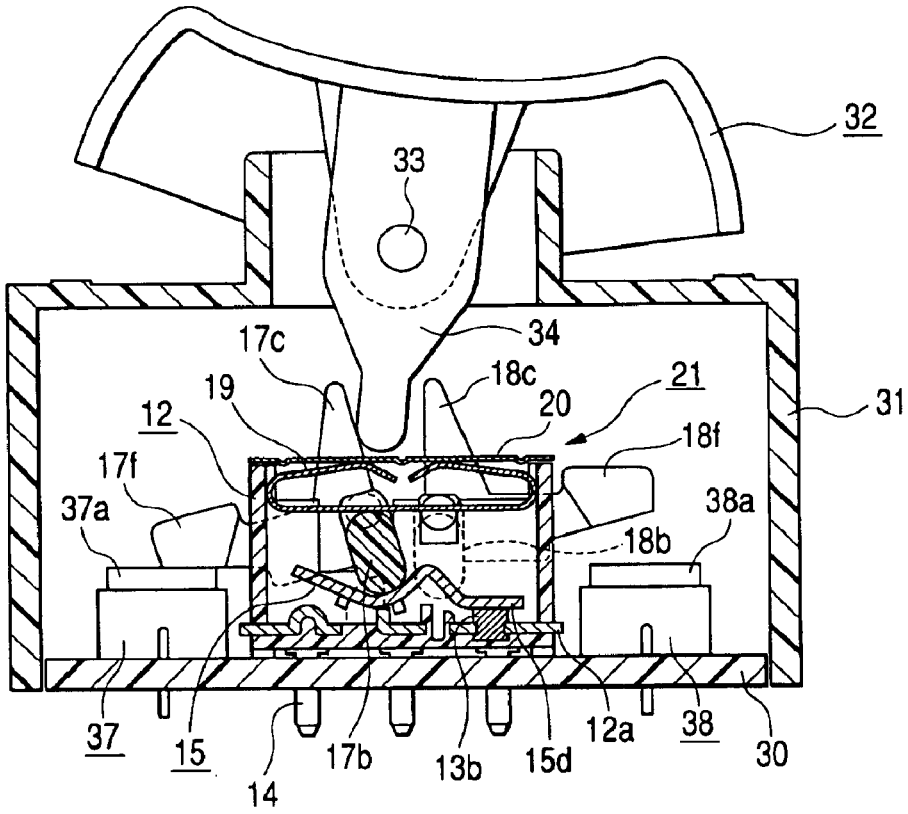
FIG. 10 is a sectional view of the driving switch illustrated in FIG. 9, in its operating state.
Figure 11:
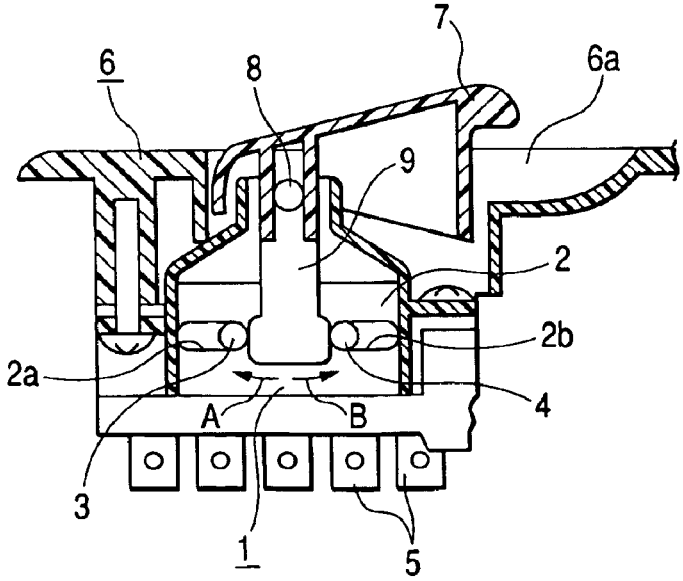
FIG. 11 PRIOR ART
FIG. 11 is an explanatory view illustrating a conventional example.

FIG. 7 is an exploded perspective view of a switch unit according to another embodiment of the present invention, FIG. 8 is a perspective view of the switch unit, FIG. 9 is a sectional view of a driving switch in its non-operating state, in which the switch unit is combined with a rocker-type operating knob, and FIG. 10 is a sectional view of the driving switch illustrated in FIG. 9, in its operating state. Since elements corresponding to those in FIGS. 1 to 4 are denoted by the same reference numerals, the repeated description will be omitted.

A switch unit 21 illustrated in FIGS. 7 to 10 is different from the switch unit 11 in that driving arm parts 17*f* and 18*f* are respectively provided in the driving bodies 17 and 18 so as to largely protrude laterally from the case 12. The other construction of the switch unit 21 is the same as that of the switch unit 11. Further, in this embodiment, a pair of push switches 37 and 38 is juxtaposed in the vicinity of the case 12 of the switch unit 21. The push switches 37 and 38 are mounted on a circuit substrate 30. Operating portions 37*a* and 38*a* of the push switches 37 and 38 are respectively disposed below the driving arm parts 17*f* and 18*f*. Also, the driving arm part 17*f*, which is lowered along with the rotation of the driving body 17, pushes in the operating portion 37*a*, so that the push switch 37 can be switched from its OFF state to its ON state. Further, the driving arm part 18*f*, which is lowered along with the rotation of the driving body 18, pushes in the operating portion 38*a*, such that the push switch 38 can be switched from its OFF state to its ON state.

In other words, for example, when an operating force for pushing in the right end of the operating knob 32 is applied in the standby state illustrated in FIG. 9, as previously described, the operating rod 34 drives to press the pressed part 17*c* to rotate the driving body 17 in the counterclockwise direction in the drawing. Therefore, the sliding part 17*b* slides on the rising part 15*b* in the upwardly inclined direction, and at the time when the conductor plate 15 is driven to rotate in the clockwise direction in the drawing, an ON signal (a driving signal by which a window is opened) is output from the switch element at the contact accommodation space S1. In this state, when the right end of the operating knob 32 is further pushed in, the operating rod 34 further pushes in the pressed part 17*c*. Therefore, the driving body 17 further rotates in the counterclockwise direction in the drawing to cause the driving arm part 17*f* to push the operating portion 37*a* downward. As a result, an ON signal (a driving signal by which a window is fully opened) is output from the push switch 37. Meanwhile, while the push switch is operated, the sliding part 17*b* further slides on the rising part 15*b* of the conductor plate 15 which has already completed its rotation in the clockwise direction in the drawing, and the pressing piece 19*a* of the plate spring member 19 is further upwardly pushed and flexed. Accordingly, when the operating force applied to the operating knob 32 is removed, the restoring force of the pressing piece 19*a* causes the driving body 17 to rotate in the opposite direction. Along with the rotation of the driving body 17, the push switch 37 and the conductor plate 15 are respectively returned to their original states that are standby states illustrated in FIG. 9.

Further, in the standby state illustrated in FIG. 9, the operation of the driving switch when an operating force for pushing in the left end of the operating knob 32 is applied is the same as the above-described operation. When the operating rod 34 drives to press the pressed part 18*c* to rotate the driving body 18 in the clockwise direction in the drawing by a predetermined angle of rotation, an ON signal (a driving signal by which a window is closed) is output from the switch element at the contact accommodation space S2. In this state, when the operating knob 32 is further pushed in and the driving body 18 is further rotated in the clockwise direction in the drawing, the driving arm part 18*f* pushes in the operating portion 38*a* downward. As a result, an ON signal (a driving signal by which a window is fully closed) is output from the push switch 38.

As described above, in the present invention, a multifunctional driving switch which can perform a manual opening or closing operation by opening or closing a window by a certain amount, when the operating knob 32 is slightly pushed in and which can perform an automatic opening or closing operation by fully opening or closing a window, when the operating knob 32 is deeply pushed in, comes true, particularly, without complicating the structure and increasing the size.

Further, the internal structure of the switch unit including the fixed contacts, the conductor plates, the plate spring member, etc., is not limited to the above-described embodiments, and various modifications other than this structure can also be adopted.

What is claimed is:

1. A switch device comprising:

a case having a bottom wall and an upper opening, two sets of switch elements assembled to the case;

a spring member for applying a returning force to the two sets of switch elements; and a cover member for covering the upper opening of the case, wherein the switch elements include fixed contact members exposed on an inner wall surface of the case, conductor members disposed in the case and capable of being brought into contact with or separated from the fixed contact members, and rotatable driving bodies for driving the conductor members, wherein pressed parts are respectively provided in the driving bodies so as to protrude above the cover member, and opposite pressing forces are respectively applied to the pressed parts of the two sets of switch elements, and wherein, during operation, the driving bodies are driven to rotate via the pressed parts so that the conductor members are brought into contact with or separated from the fixed contact members, thereby allowing any of the two sets of switch elements to selectively perform a set of opening and closing operations, and as the pressing forces are released, the driving bodies are returned to non-operating positions.

2. The switch device according to claim 1, wherein the fixed contact members of the switch elements are disposed on a bottom face of the inner wall surface, and the conductor members respectively provided with inclined surfaces are rockably disposed on the bottom face of the inner wall surface, wherein the spring member is formed of a plate spring and is attached to the case in a state pressed by the cover member, wherein the driving bodies are allowed to be elevated and are rotatably held in the case, and sliding parts are provided to be brought into resilient contact with the conductor members by the biasing force of the plate spring member, and wherein, when the driving bodies are driven to rotate via the pressed parts, the sliding parts slide on the inclined surfaces of the conductor members, the conductor members rock so that they are brought into contact with or separated from the fixed contact members, and at the same time the driving bodies moves against the biasing force of the plate spring.

3. The switch device according to claim 1, wherein the driving bodies are respectively provided with driving arm parts that protrude laterally from the case.

4. The switch device according to claim 3, wherein the driving arm parts are disposed above push switches juxtaposed in the vicinity of the case and the driving bodies are driven to rotate via the pressed parts, so that the driving arm parts operate to press the push switches.

5. The switch device according to claim 1, further comprising a rockable operating knob having an operating rod inserted between the pressed parts of the two sets of switch elements.

6. The switch device according to claim 1, further comprising a slidable operating knob having driving projection inserted between the pressed parts of the two sets of switch elements.

* * * * *